US006966610B2

(12) United States Patent
Mills

(10) Patent No.: US 6,966,610 B2
(45) Date of Patent: Nov. 22, 2005

(54) TREATMENT OF ROCK SURFACES

(75) Inventor: Peter Shelley Mills, Stamping Ground, KY (US)

(73) Assignee: Minova International Limited, Witan Way Witney (GB)

( * ) Notice: Subject to any disclaimer, the term of this patent is extended or adjusted under 35 U.S.C. 154(b) by 0 days.

(21) Appl. No.: 10/203,007

(22) PCT Filed: Feb. 21, 2001

(86) PCT No.: PCT/GB01/00717

§ 371 (c)(1),
(2), (4) Date: Aug. 5, 2002

(87) PCT Pub. No.: WO01/63096

PCT Pub. Date: Aug. 30, 2001

(65) Prior Publication Data

US 2003/0011235 A1 Jan. 16, 2003

Related U.S. Application Data

(60) Provisional application No. 60/183,819, filed on Feb. 22, 2000.

(51) Int. Cl.[7] ..... E21D 11/00; E21D 11/38
(52) U.S. Cl. ..... 299/11; 299/12; 405/266; 405/287.1; 405/288; 405/302.4; 405/150.2
(58) Field of Search ..... 405/150.1, 150.2, 405/263, 266, 272, 287.1, 288, 302.4; 299/11, 299/12

(56) References Cited

U.S. PATENT DOCUMENTS 4,093,485 A 6/1978 Ornsteen
4,114,382 A * 9/1978 Kubens et al. ..... 405/264
4,341,301 A * 7/1982 Meyer et al. ..... 206/219
4,368,924 A 1/1983 Nussbaumer
4,475,847 A * 10/1984 Cornely et al. ..... 405/264
4,607,066 A * 8/1986 Barry et al. ..... 523/130
4,746,248 A * 5/1988 Lillis et al. ..... 405/259.5
5,375,766 A 12/1994 Sweeney
5,401,792 A * 3/1995 Babu et al. ..... 524/270
5,925,409 A * 7/1999 Nava ..... 427/238

FOREIGN PATENT DOCUMENTS

DE 1 187 657 2/1965
DE 28 23 898 12/1978
DE 37 05 095 9/1988
EP 0 254 501 A 1/1988

(Continued)

OTHER PUBLICATIONS

"Occupational Hazards of Spray-on Liner Applications in Underground Environments: Truths and Myths", Archibald,, Espley, DeGagne, and Bickis, 101st Annual General Meeting of the Canadian Institute of Mining, Metallurgy and Petroleum, May 1999.*

(Continued)

*Primary Examiner*—Katherine Mitchell
(74) *Attorney, Agent, or Firm*—Nixon & Vanderhye P.C.

(57) ABSTRACT

A method for providing a protective coating in a mine comprising spraying onto the rock surfaces of the mine a hot melt adhesive in an amount to form a coating at least 1 mm, preferably at least 2 mm in thickness and allowing the coating to solidify. The hot melt adhesive preferably has a melting point on the range from 70 to 250 degrees Centigrade and may include a filler such as an inert material in finely divided form such as ground limestone, mica, sand and silica, the filler comprising between 1 and 40% by weight of the combined weight of adhesive and filler.

12 Claims, 1 Drawing Sheet

FOREIGN PATENT DOCUMENTS

| | | | | |
|---|---|---|---|---|
| EP | 0 761 457 | | 3/1997 | |
| FR | 2 393 044 | | 12/1978 | |
| FR | 2082655 | A * | 3/1982 | ..... E21D 20/02 |
| FR | 2 750 430 | | 1/1998 | |
| GB | 2 159 512 | | 12/1985 | |
| JP | 63-161067 | | 7/1988 | |
| WO | WO 98 58886 | | 12/1998 | |
| ZA | 82/3384 | | 5/1982 | |

OTHER PUBLICATIONS

"Thin Spray-on Linings for Rock Failure Stabilization", Archibald, J. F. and Lausch, P.; 37th U.S. Rock Mechanics Symposium—Rock Mechanics for Industry, Vail, Colorado, Jun., 1999, pp. 617-624.*

"Recent Canadian Advances in the Application of Spray-on Polymeric Linings", Archibald, J. F. and DeGagne, D, O.; Mining Health and Safety Conference 2000, Sudbury, Ontario, Apr., 2000, 21 pages.*

Espley, Tannant, Baiden, Kaiser , "Design Criteria for Thin Spray-On Membrane Support for Underground Hardrock Mining", Calgary '99 CIM-AGM, May 1999, 7 pages□□.*

Pritchard et al., "TekFlex as a Spray-on Screen Replacement in an Underground Hard Rock Mine", Calgary '99 CIM-AGM, May 1999, 6 pages.*

Tannant et al. "Laboratory Test Procedures for Validating the Use of Thin Sprayed-On Liners for Mesh Replacement", Calgary '99 CIM-AGM, May 1999, 8 pages.*

"Validation of Rock Reinforcement Capacity Offered by Spray-on Mine Coatings"; Archibald, J. F. and Nicholls, T.; 102nd Annual General Meeting of the Canadian Institute of Mining, Metallurgy and Petroleum—CD-ROM Publication, Mar., 2000, 9 pages.*

Patent Abstracts of Japan vol. 008, No. 145, Jul. 6, 1984 and JP 59 053572 A, Mar. 28, 1984.

* cited by examiner

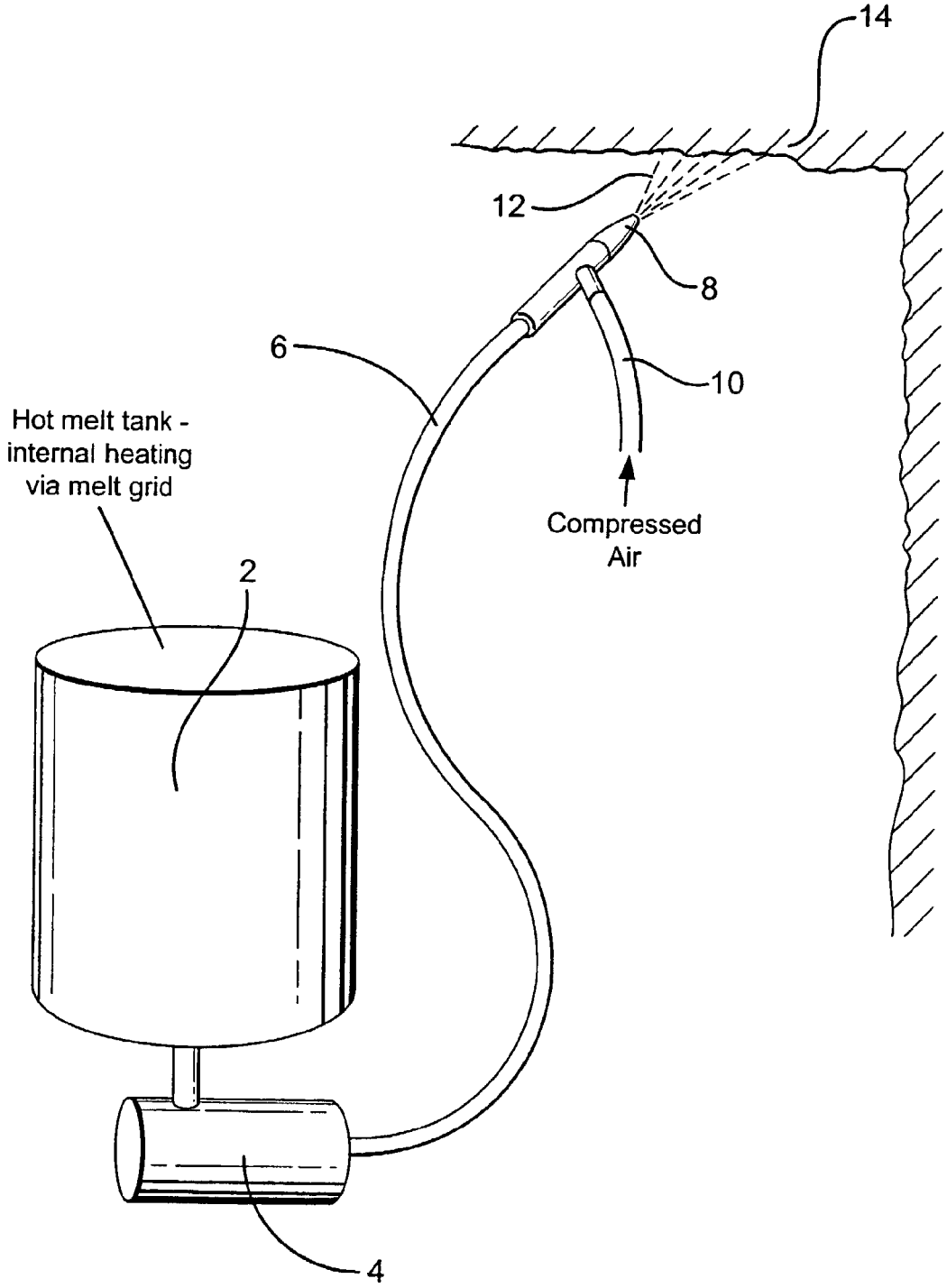
14
12
8
6
10
Hot melt tank - internal heating via melt grid
Compressed Air
2
4

TREATMENT OF ROCK SURFACES

This application is the U.S. national phase international application PCT/GB01/00717 filed 21 Feb. 2001 which designated the U.S. and claims the benefit of Provisional Application No. 60/183,819, file Feb. 22, 2000.

FIELD OF THE INVENTION

This invention relates to a method for the treatment of rock surfaces more particularly to the formation of a protective coating on the rock surfaces by the application of a molten adhesive to the rock surfaces, and the rock surfaces so treated.

BACKGROUND OF THE INVENTION

It has been previously proposed to apply a coating of a polymer for example a polyurethane or polyurea to a mine surface by spraying the polymer-forming reactants onto the surface to be coated.

Alternatively rock surfaces in mines have been coated by spraying an aqueous emulsion of an organic polymer for example a polychloroprene and causing the polymer to coagulate to produce a flexible coating in the form of a film or skin on the surface. This technique has been described in South African Patent No 8203384.

More recently there has been described in WO 98/58886 a composition comprising two parts. One is an aqueous emulsion of an organic polymer such as the copolymer of ethylene and vinyl acetate. The other part is a cementitious composition capable of absorbing at least its own weight of water. The cementitious composition described is an ettringite-forming composition containing high alumina cement, ordinary Portland cement and anhydrite.

PROBLEM TO BE SOLVED BY THE INVENTION

Compositions described in the above mentioned WO 98/58886 take a significant time, typically about 8 hours, to reach an adequate early strength. For mining operations there is a need to reduce this time. The present invention provides a solution to this problem by a method in which a hot melt adhesive is sprayed onto the rock surfaces of the mine.

SUMMARY OF THE INVENTION

According to the present invention there is provided a method for providing a protective coating in a mine which method comprises forming the coating on the rock surfaces of the mine by spraying onto the rock surfaces, for example the walls and/or roof of the mine, a hot melt adhesive in an amount to form a substantially uniform coating at least 1 mm, preferably at least 2 mm, in thickness and allowing the coating to solidify, and the rock surfaces so produced.

ADVANTAGEOUS EFFECT OF THE INVENTION

The hot melt adhesive hardens more quickly than the previously described cement-containing coatings and enables the down time in the mine to be greatly reduced. In one application the hot melt adhesive is used as a replacement for wire mesh and this quick hardening property enables the support characteristics of wire mesh to be reached in less time.

BRIEF DESCRIPTION OF THE DRAWINGS

The drawing is a schematic representation of the spraying apparatus used in the invention.

DETAILED DESCRIPTION OF THE INVENTION

The term mine in the present specification is intended to include all underground workings including tunnels and quarries.

When used for support in a mine, for example as a substitute for steel mesh, the product is a flexible coating on the rock surface. By flexible is meant the ability of the coating to deform and allow pieces of rock to move and retain the ability to take load.

It has been found that a coating of about 4 mm in thickness e.g. from about 3 to 7 mm may be used as a replacement for wire mesh to prevent spalling and loose rock fragments from falling. Such mesh is referred to in the USA as No 7 mesh. The coatings may be used in mines which are known as hard rock mines such as nickel or gold mines and also in coal mines.

The coatings may be used for example when mining coal by the room and pillar method to reduce the size of the pillars which are left to provide support and thereby recover more coal. This is achieved by spraying the coating onto the pillars thereby increasing their load bearing ability.

The coating may also be applied to reduce or prevent weathering, that is the erosion of freshly exposed rock surfaces by air in the mine or for the suppression of radon gas in a uranium mine or for the stabilisation of embankments for example in a quarry for stabilising roofs of tunnels and the like.

Hot melt adhesives are well known and generally comprise thermoplastic materials which when heated melt and are capable of wetting a substrate. When cooled these materials solidify and firmly adhere to the substrate. Materials which have been used as hot melt adhesives include polyolefins such as polyethylene and polypropylene, rubbers, polyesters such as polyvinyl acetate and polyamides. Copolymers such as the copolymers of ethylene and vinyl acetate are particularly suitable.

Wax is often added to hot melt adhesives to lower viscosity and to reduce cost. However wax has the effect of reducing adhesion, especially to non porous substrates, and it is therefore preferred that the hot melt adhesives used in the present invention contain less than 5% by weight of wax, more preferably less than 1% most preferably are substantially free of wax.

Preferably the hot melt adhesive contains one or more ingredients to improve adhesion and supplement the toughness of the hot melt adhesive for example wood rosin and derivatives of wood rosin such as ester derivatives, hydrocarbon resins, terpenes and modified terpenes. These materials may typically comprise 20 to 50% by weight of the total composition.

The hot melt adhesives may contain plasticisers to improve flexibility and adhesion through improved substrate wetting.

A particularly suitable material for use in the present invention is a hot melt adhesive sold by H.B. Fuller Company Inc of the U.S.A. under the trade name of 130 ML Best Bond which is an ethylene vinyl acetate copolymer containing no significant amount of wax. The material is also available under the commercial trade designation of HM-2123 Best Bond.

This adhesive has a Mettler softening point by ASTM D3461 of 190° F., a specific gravity of 0.96 and a viscosity at 350° F. of 11,200 centipoise.

Suitable materials are also described in European Patent Nos 761457A and 89170A and Japanese Patent No 63161067A.

The hot melt sprayable adhesives for use in the present invention should have an open time (which is the time taken for the adhesive to revert back to its solid and non tacky state after it has been applied as a coating) sufficient to allow it to penetrate cavities and cracks.

The hot melt adhesive should have a melting point in the range from 70 to 250° C., preferably in the range from about 110 to 220° C.

A filler may be included in the adhesive. Suitable fillers include inert minerals in finely divided form such as ground limestone, mica, sand and silica.

Preferred fillers are those that will impart fire retarding properties such as alumina trihydrate.

Up to about 70% by weight of filler, typically up to about 40%, may be employed based on the combined weight of adhesive and filler (e.g. between about 1–40%, or between about 1–70%, by weight filler).

Desirably the hot melt adhesive (including filler and other components when present) will have a tensile strength of at least 500 psi, a minimum elongation of 50%, a minimum adhesion to concrete of 300 psi and a maximum viscosity of 70,000 cps at 350° F.

The spraying may be carried out by the use of a spray gun for example Hot Shot Adhesive gun available from Sericol Limited of the United Kingdom which uses compressed air at up to 10 bar and preferably from 5 to 7 bar.

Power HB 600 spray melt, a spray gun available from Power Adhesives Limited of the United Kingdom is also suitable for use in the present invention. The gun uses compressed air at up to 8 bar heated to 70 to 250° C.

The spraying may conveniently be carried out using a hand held spray gun provided with an electrically heated compartment for the adhesive and means for supplying air under pressure to the molten adhesive to assist the spraying. Instead of the gun being hand held the adhesive may be automatically applied using an automatic spray gun or other applicators.

The Hot Shot Adhesive gun uses cores of adhesive. The cores of adhesive are placed in the barrel of the gun. Part of the core at the firing end of the gun barrel is heated by an electrical component to the molten sprayable state. The cores in the solid state form a piston to help force the molten adhesive through the nozzle and out of the gun which needs to be capable of spraying the hot molten adhesive from the gun. The nozzle preferably has a diameter of from 0.8 mm to 1.5 mm more preferably from 1 mm to 1.2 mm. Details of the Hot Shot Adhesive gun are described in U.S. Pat. No. 5,375,766. Details of the adhesive cores can be found in French Patent No 2,393,044 and German Patent No 2,823,898.

The spray gun should be adjusted so that the hot melt spray is even and fine and the adhesive lays flat on the surface to which it is applied.

An alternative method of application is shown in the accompanying drawing. Referring to the drawing: the spraying apparatus comprises a drum 2 of 60 gallon capacity heated internally by a melt grid (not shown) containing the hot melt adhesive. Melted adhesive is withdrawn from the base of the drum 2 by means of a pump 4 and fed by means of a hose 6 to a spray nozzle 8. Compressed air is supplied by line 10 to hose 6 at the nozzle 8 to generate a spray 12 of hot melt adhesive which is applied to rock substrate 14.

Chips of premixed adhesive and filler are continuously supplied to the drum 2 to maintain a continuous spraying operation.

In a modification of this method of application a solid block of adhesive (and filler if used) contained in the drum is heated using a circular hot plate placed on the top of the block. The plate descends in the drum and melted material is caused to pass through a hole in the heated plate and pumped away for application.

The invention avoids the risk of exposure to toxic chemicals associated with the use of polyurethanes and also avoids the need for a time consuming clean up operation that is needed when applying coatings containing cement materials. Also, solidifying of the coating takes place very quickly, typical from between a few seconds to sixty minutes (to reach the solidification necessary).

In the above disclosure all narrower ranges within a broad range are also specifically included. For example, about 1–70% filler means 2–65%, 28–35%, 4–40%, and all other narrower ranges within the broad range. The invention is to be interpreted as broadly as allowed by the prior art.

What is claimed is:

1. A method for providing a protective coating on at least one rock surface in a mine comprising the steps of:

(a) providing a source of a solid thermoplastic polymeric hot melt adhesive;

(b) forming a melt-flow of the hot melt adhesive from the source thereof;

(c) spraying a sufficient amount of the melt-flow of hot melt adhesive onto the at least one rock surface of the mine to form a coating thereon of at least 1 mm in thickness, and (d) allowing the coating to solidify thereby to provide a protective coating on the at least one rock surface of the mine.

2. A method as recited in claim 1 wherein step (c) is practiced by spraying the walls and roof of the mine.

3. A method as recited in claim 1 wherein step (c) is practiced by spraying sufficient hot melt adhesive so as to form a coating at least 2 mm thick.

4. A method as recited in claim 1 wherein step (a) is practiced using a hot melt adhesive having a tensile strength of at least 500 psi, a minimum elongation of 50%, a minimum adhesion to concrete of 300 psi, and a maximum viscosity of 70,000 cps at 350° F.

5. A method as recited in claim 1 wherein step (a) is further practiced using as the hot melt adhesive one having a filler comprising an inert mineral in finely divided form, the filler comprising between about 1–40% by weight of the combined weight of adhesive and filler.

6. A method as recited in claim 5, wherein the filler is at least one selected from the group consisting of ground limestone, alumina trihydrate, mica, sand and silica.

7. A method as recited in claim 1 wherein step (a) is further practiced using as the hot melt adhesive one have a melting point in the range from about 70 to 250° C. and a filler that will impart fire retarding properties.

8. A method as recited in claim 7, wherein the filler includes alumina trihydrate.

9. A method as recited in claim 1, wherein the hot melt adhesive is in the form of solid chips or a solid block.

10. A method as recited in claim 1 or 9, wherein step (b) is practiced by electrically heating the solid hot melt adhesive to form a melt flow thereof.

11. A method as recited in claim 10, wherein step (c) further comprises the steps of (c1) supplying the melt-flow of hot melt adhesive to a spray gun, and (c2) providing the spray gun with compressed air to thereby spray the melt-flow of hot melt adhesive therefrom.

12. A method as recited in claim 1, wherein step (c) further comprises the steps of (c1) supplying the melt-flow of hot melt adhesive to a spray gun, and (c2) providing the spray gun with compressed air to thereby spray the melt-flow of hot melt adhesive therefrom.

* * * * *